US010390118B2

(12) United States Patent
Sano

(10) Patent No.: US 10,390,118 B2
(45) Date of Patent: Aug. 20, 2019

(54) SOUND COLLECTING DEVICE

(71) Applicant: AUDIO-TECHNICA CORPORATION, Tokyo (JP)

(72) Inventor: Yusuke Sano, Machida (JP)

(73) Assignee: AUDIO-TECHNICA CORPORATION, Machida-Shi, Tokyo (JP)

( * ) Notice: Subject to any disclaimer, the term of this patent is extended or adjusted under 35 U.S.C. 154(b) by 0 days.

(21) Appl. No.: 16/014,531

(22) Filed: Jun. 21, 2018

(65) Prior Publication Data

US 2019/0014399 A1 Jan. 10, 2019

(30) Foreign Application Priority Data

Jul. 5, 2017 (JP) ..... 2017-131683

(51) Int. Cl.
*H04R 1/02* (2006.01)
*H04R 1/08* (2006.01)
*H04R 1/40* (2006.01)

(52) U.S. Cl.
CPC ..... *H04R 1/02* (2013.01); *H04R 1/086* (2013.01); *H04R 1/406* (2013.01)

(58) Field of Classification Search
CPC ..... H04R 1/02; H04R 1/086; H04R 1/406
USPC ..... 381/368
See application file for complete search history.

(56) References Cited

U.S. PATENT DOCUMENTS 6,549,802 B2 * 4/2003 Thornton ..... A61B 6/12 600/426
9,294,838 B2 * 3/2016 Christoph ..... H04R 3/005
9,451,162 B2 * 9/2016 Van Hoff ..... G11B 27/11
2015/0054913 A1 2/2015 Annau et al.

FOREIGN PATENT DOCUMENTS

JP 5304293 B2 10/2013
JP 2016-538790 A 12/2016

* cited by examiner

*Primary Examiner* — Brian Ensey
(74) *Attorney, Agent, or Firm* — Manabu Kanesaka

(57) ABSTRACT

A sound collecting device includes a microphone array having unit holders each of which a microphone unit is attached to. Connection of connecting portions formed on the holders to each other causes a directional axis of each microphone unit to be directed outward from a face of a regular polyhedron. The sound collecting devices further includes a frame disposed outside the microphone array so as to surround the microphone array and an even number of ring-shaped elastic bodies that connect a part of the frame and the connected holders at a plurality of positions such that the microphone array is positioned at a central portion of the frame, wherein a half of the even number of elastic bodies are connected twistedly in one direction from the frame toward the microphone array, and another half elastic bodies are connected twistedly in an opposite direction.

8 Claims, 4 Drawing Sheets

SOUND COLLECTING DEVICE

RELATED APPLICATIONS

The present application is based on, and claims priority from, Japanese Application No. JP2017-131683 filed Jul. 5, 2017, the disclosure of which is hereby incorporated by reference herein in its entirety.

BACKGROUND OF THE INVENTION

Field of the Invention

The present invention relates to a sound collecting device that includes a plurality of microphone units, and more particularly to a sound collecting device in which respective directional axes of microphone units are directed outward from the faces of a regular polyhedron.

Description of the Related Art

An Ambisonics microphone has been proposed in which a plurality of microphone units is disposed in a manner where the respective directional axes thereof are directed outward from the faces of a regular polyhedron so as to collect stereophonic sound.

In the most basic configuration of the Ambisonics microphone, a unidirectional microphone unit is disposed on each face of a regular tetrahedron.

Such Ambisonics microphones have been commercialized, and one form thereof is disclosed in JP 2016-538790 A (Patent Document 1).

This Ambisonics microphone is shown in FIG. 3C of JP 2016-538790 A.

Four microphone units constituting the Ambisonics microphone are each fixed to a fixing member to form a microphone array.

The fixing member constituting the microphone array is attached to an end of a mount member via a bifurcated connecting member.

According to the Ambisonics microphone disclosed in JP 2016-538790 A, when vibration is transmitted to the mount member, the vibration is directly transmitted to each microphone unit through the bifurcated connecting member and the fixing member. This causes generation of vibration noise.

In order to prevent generation of vibration noise due to the above-described transmission of vibration, a sound collecting device that supports a microphone unit with an elastic body made of rubber, for example, has been proposed. Such an example is disclosed in Japanese Patent No. 5304293 (Patent Document 2).

The arrangement of respective microphone units of the sound collecting device disclosed in Japanese Patent No. 5304293 is different from that of the above-described Ambisonics microphone. That is, the sound collecting device disclosed in Japanese Patent No. 5304293 includes three microphone units disposed on a base member such that the respective directional axes thereof are in the same plane. The three microphone units are supported, in a floating state, by elastic bodies made of rubber attached to three support posts standing on the base member.

SUMMARY OF THE INVENTION

In an Ambisonics microphone, the respective microphone units need to be disposed in a manner where the respective directional axes of the microphone units are properly directed outward from the faces of a regular polyhedron.

For example, in an Ambisonics microphone in which microphone units are mounted on the respective faces of a regular tetrahedron, the respective directional axes of the microphone units are directed upward in the left front direction (Lf), downward in the left rear direction (Lb), downward in the right front direction (Rf), and upward in the right rear direction (Rb).

In order to adopt a floating structure for preventing transmission of vibration to the microphone array, the four directional axes need to be accurately positioned, with great care, between an outer frame member supporting the microphone array and the microphone array. In addition, consideration should be needed for the microphone array to be floatingly supported on the frame member in a balanced state.

Accordingly, in order to solve the major problems described above, an object of the present invention is to provide a sound collecting device with the following configuration. In a sound collecting device where a microphone array constituting an Ambisonics microphone is supported by a frame member disposed outside so as to surround the microphone array with elastic bodies provided between the microphone array and the frame member, the directional axis of each microphone unit can be accurately positioned, and the microphone array is floatingly supported by the frame member in a balanced state.

The sound collecting device according to the present invention includes a microphone array having unit holders each of which a microphone unit is attached to, the unit holders having connecting portions formed on the holder, the connecting portions being connected to each other such that a directional axis of each microphone unit is directed outward from a face of a regular polyhedron; a frame member disposed outside the microphone array so as to surround the microphone array; and an even number of ring-shaped elastic bodies that connect a part of the frame member and the unit holders connected to each other at a plurality of positions therebetween such that the microphone array is positioned at a central portion of the frame member, wherein a half of the even number of elastic bodies are connected twistedly in one direction from the frame member toward the microphone array, and the other half of the elastic bodies are connected twistedly in an opposite direction from the frame member toward the microphone array.

In this case, it is preferable that the ring-shaped elastic bodies are disposed in a manner to straddle the connecting portions formed on the unit holders, and disposed on the unit holder side as a result that the connecting portions are connected to each other.

The respective elastic bodies adjacent to each other in a circumferential direction are twisted in directions opposite to each other.

In addition, it is preferable that the ring-shaped elastic bodies are O-rings each formed of a rubber material. Each of the O-rings connects each connecting portion that connects the unit holders to each other and each locking portion formed on an inner peripheral edge of the frame member, in a circular manner, such that the microphone array is positioned at the central portion of the frame member.

Meanwhile, the connecting portions formed on the unit holder are placed at positions with equal intervals along the circumferential direction of the unit holder.

Furthermore, it is desirable that the frame member is formed in a flat shape, and has an arrangement space for the microphone array, formed in a quadrilateral shape along the inner peripheral edge, and that the locking portions of the O-rings are formed at respective longitudinal central positions of the quadrilateral inner peripheral edge.

Moreover, it is possible to suitably adopt a configuration in which both sides of the flat-shaped frame member are each provided with a windscreen capable of covering the microphone array without coming into contact therewith.

According to the sound collecting device of the present invention as described above, the microphone array constitutes an Ambisonics microphone, in which the directional axis of each microphone unit is directed outward from a face of a regular polyhedron, and is connected to the frame member surrounding the microphone array through a plurality of the elastic bodies. As a result, whereby provided is a sound collecting device in which vibration noise can be effectively suppressed.

Furthermore, since the microphone array is supported by the elastic bodies in a balanced state, the respective microphone units are evenly disposed in terms of a distance and an angle with respect to the frame member.

Accordingly, no deviation occurs in the positions of respective acoustic terminals occurring in the vicinity of a sound collecting portion of each microphone unit. Therefore, with such an Ambisonics microphone, no deviation occurs in collected sound, and thus, highly accurate natural sound collection is achieved.

DESCRIPTION OF THE PREFERRED EMBODIMENTS

A sound collecting device according to the present invention will be described based on an embodiment with reference to the drawings.

Figure 1:
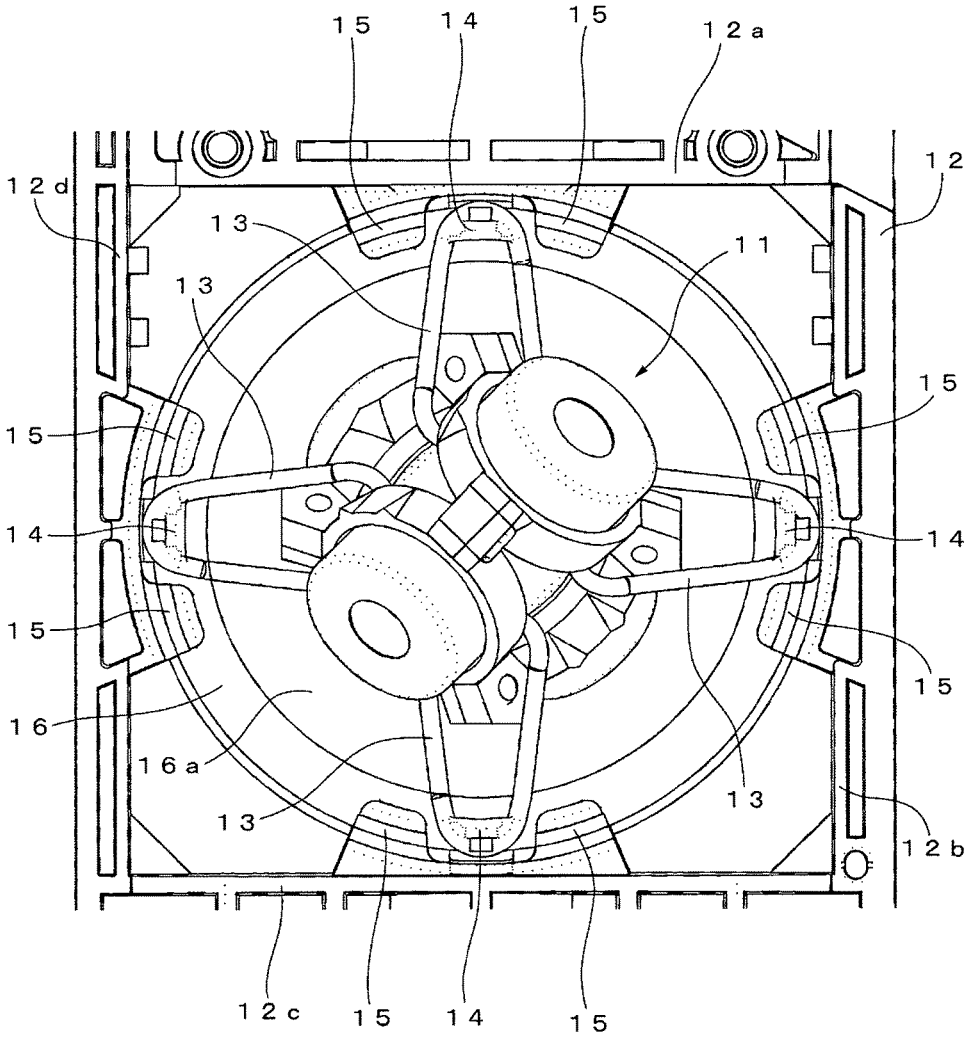
FIG. 1 is a front view of a sound collecting device according to the present invention in a state where a windscreen provided at the front side has been detached.

FIG. 1 shows the sound collecting device according to the present invention in a state in which a windscreen provided at the front side has been detached. The sound collecting device functions as an Ambisonics microphone. In the Ambisonics microphone shown in the present example, the respective directional axes of microphone units are directed outward from the respective faces of a regular tetrahedron.

First, based on FIGS. 2A to 4, the configuration of a microphone array as an Ambisonics microphone will be described.

Figure 2A:
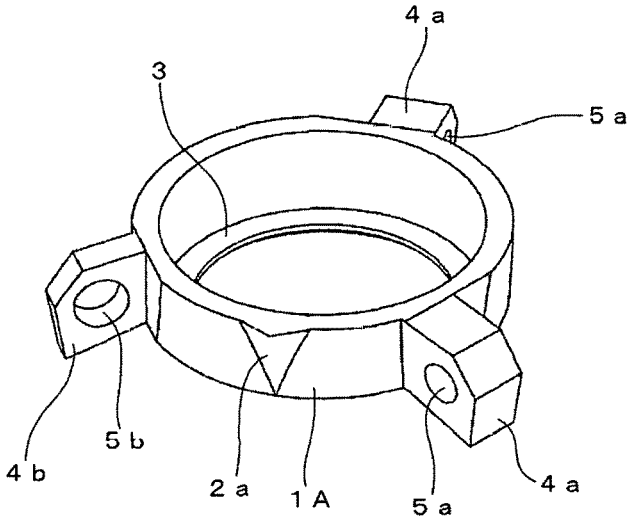
FIG. 2A is a perspective view of an upper unit holder among unit holders to which microphone units are respectively attached.
Figure 2B:
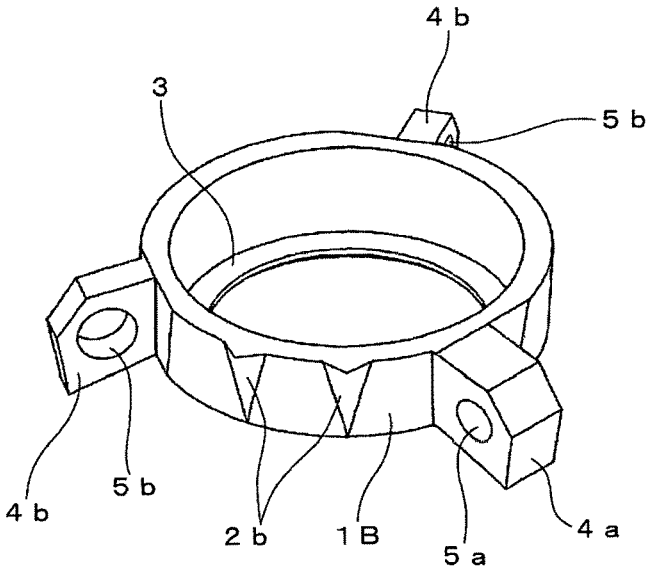
FIG. 2B is a perspective view of a lower unit holder among the unit holders to which the microphone units are respectively attached.

FIGS. 2A and 2B show an external-appearance configuration of a unit holder to which each microphone unit to be attached. FIG. 2A shows an upper unit holder, and FIG. 2B shows a lower unit holder.

The upper unit holder 1A shown in FIG. 2A is formed in a ring shape. One wedge-shaped protrusion 2*a* is formed on a part of its outer peripheral surface so as to indicate that it is the upper unit holder. At its lower bottom, a stopper 3 for locking the back of the microphone unit, which will be described below, is formed in a ring shape toward the inner peripheral surface.

On the outer peripheral surface of the upper unit holder 1A, connecting portions 4*a* and 4*b* are formed to direct outward. Female threads 5*a* are formed in two of the connecting portions 4*a*, having a larger thickness. Additionally, an insertion hole 5*b* through which a screw is to be inserted, as described below, is formed in a connecting portion 4*b* having a smaller thickness.

The respective connecting portions 4*a* and 4*b* are placed on the upper unit holder 1A at equal intervals along the circumferential direction of the upper unit holder 1A. That is, in the present embodiment, the connecting portions 4*a* and 4*b* are placed at intervals of 120 degrees along the circumferential direction of the upper unit holder 1A.

Two wedge-shaped protrusions 2*b* are formed on a part of the outer peripheral surface of a lower unit holder 1B shown in FIG. 2B so as to indicate that it is the lower unit holder. The female thread 5*a* is formed in the one connecting portion 4*a* having a larger thickness. The insertion hole 5*b* for a screw is formed in each of the two connecting portions 4*b* having a smaller thickness.

The other configuration of the lower unit holder 1B is similar to that of the upper unit holder 1A shown in FIG. 2A. Therefore, description thereof will be omitted.

Figure 3:
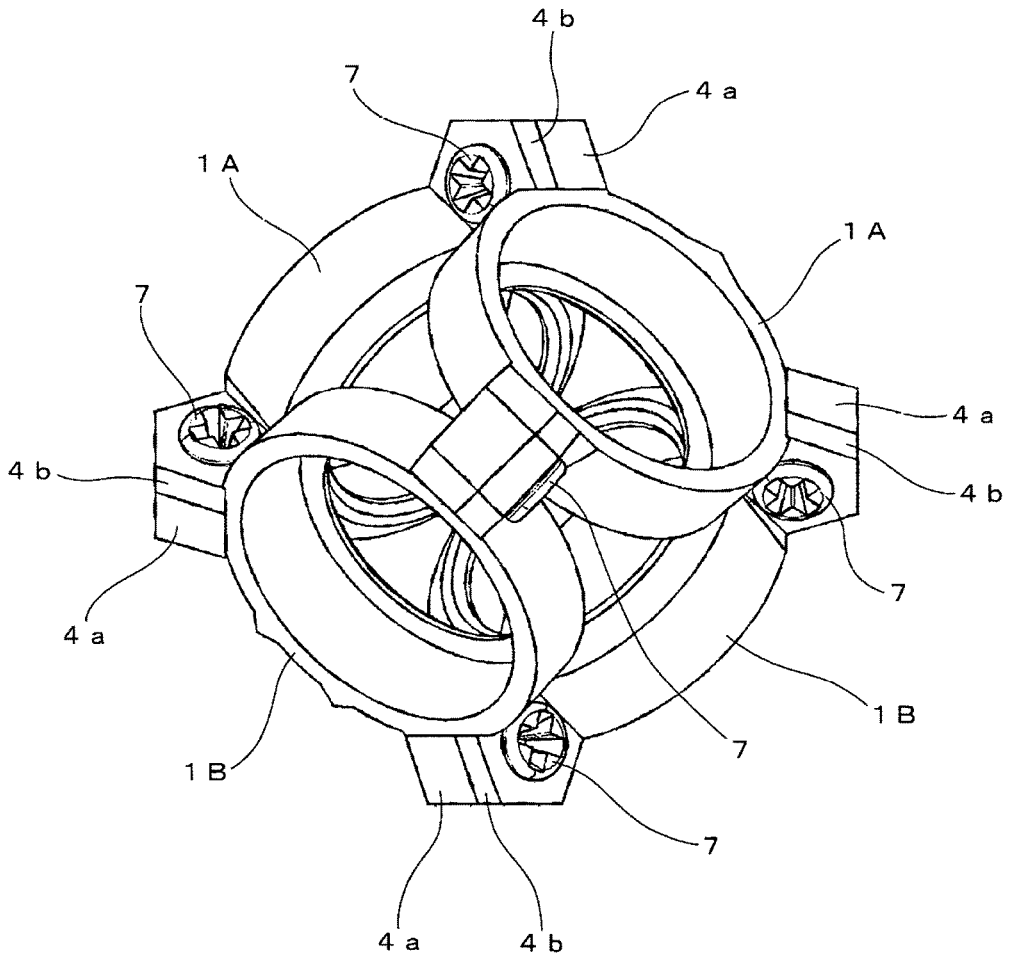
FIG. 3 is a perspective view of connecting portions formed on the unit holders, which have been connected to each other.

FIG. 3 shows the two upper unit holders 1A shown in FIG. 2A and the two lower unit holders 1B shown in FIG. 2B, which have been combined with each other. That is, FIG. 3 shows the connecting portions formed on the respective unit holders, which have been connected to each other by screws.

A screw denoted by the reference numeral 7 is first inserted into the connecting portion 4*b*, having a smaller thickness, of the unit holder, and screwed toward the female thread 5*a* of the connecting portion 4*a*, having a larger thickness, of another unit holder so as to be fastened.

Thus, an assembly of the unit holders shown in FIG. 3 is formed while the connecting portion 4*b*, having a smaller thickness, of each unit holder is fastened, with the screw 7, to the connecting portion 4*a*, having a larger thickness, of another unit holder.

Figure 4:
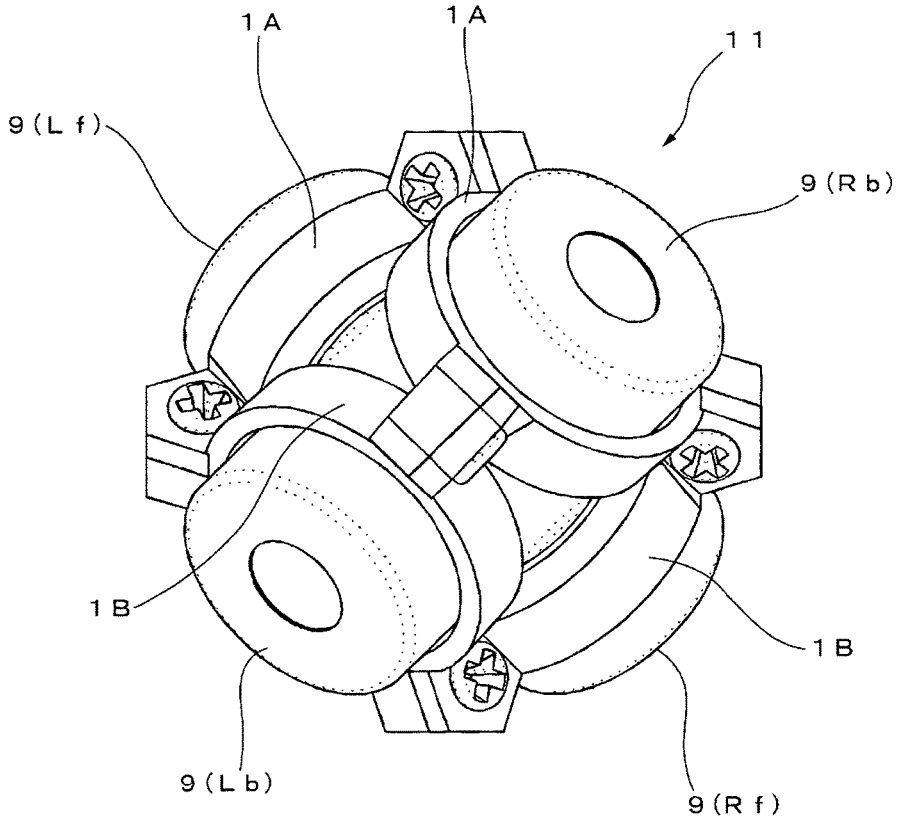
FIG. 4 is a perspective view of a microphone array formed by attaching microphone units to the respective unit holders shown in FIG. 3.

FIG. 4 shows a configuration of the unit holders to each of which a unidirectional condenser microphone unit 9 has been attached.

The condenser microphone unit 9 is formed of a cylindrical unit case having an outer shell made of aluminum alloy, for example. The condenser microphone unit 9 is attached to each unit holder such that the directional axis faces outward.

In this case, the cylindrical unit cases of the microphone units 9 are pushed until they abut against the ring-shaped stoppers 3 formed at the lower bottom of the unit holders 1A and 1B. As a result, the position of each microphone unit 9 with respect to each unit holder is fixed to form a microphone array 11 shown in FIG. 4.

The respective microphone units 9 of the microphone array 11 are disposed such that the respective directional axes of the microphone units 9 are directed outward from the respective faces of the regular tetrahedron. Therefore, the microphone array 11 functions as an Ambisonics microphone.

As shown in FIG. 1, in a state where the microphone array 11 is attached to a frame member 12 to be described below, the directional axes of the respective microphone units 9 attached to the two upper unit holders 1A are directed upward in the left front direction (Lf) and upward in the right rear direction (Rb). In addition, the respective directional axes of the respective microphone units 9 attached to the two lower unit holders 1B are directed downward in the left rear direction (Lb) and downward in the right front direction (Rf).

Furthermore, FIG. 1 shows the entire configuration of the microphone array 11, shown in FIG. 4, attached with elastic bodies 13 to the frame member 12 in a floating state.

It should be noted that in the present embodiment, the frame member 12 is formed of a resin material in a flat shape. However, it can also be formed of a metal material.

Additionally, a quadrilateral shape is formed by the inner peripheral edges of the frame member 12. A central portion of the quadrilateral shape formed by the inner peripheral edges of the frame member 12 becomes an arrangement space for the microphone array 11.

Furthermore, at the longitudinal central positions of each quadrilateral inner peripheral edge, a locking portion 14 of the elastic body 13 is formed in an arc shape along the longitudinal direction.

Four identical ring-shaped elastic bodies (for example, O-rings) made of a rubber material are used as the elastic body 13.

When the assembly of the unit holders is formed, the O-rings 13 are passed through so as to straddle the connecting portions 4*a* and 4*b* of the unit holders and attached to in advance. The connecting portions are connected to each other in this manner; whereby the O-rings 13 are disposed on the unit holder side.

Then, as shown in FIG. 1, the four O-rings 13 are locked with the respective locking portions 14.

That is, each O-ring 13 circularly couples the unit holder and corresponding locking portion 14 of the frame member 12. As a result, the microphone array 11 is positioned at the central portion of the frame member 12.

With this configuration, the frame member 12 in a floating state supports each O-ring 13 buffers vibration from the frame member 12, and the microphone array 11.

In the present embodiment, the four O-rings 13 adjacent to each other in the circumferential direction are twisted in directions opposite to each other along the circumferential direction.

That is, the O-ring 13 connecting an upper frame body 12*a* and the microphone array 11 as shown in FIG. 1 is twisted slightly to the left from the frame member 12 toward the microphone array 11. In addition, the O-ring 13 connecting a right frame body 12*b* and the microphone array 11 is twisted slightly to the right from the frame member 12 toward the microphone array 11.

Furthermore, the O-ring 13 connecting a lower frame body 12*c* and the microphone array 11 is twisted slightly to the left from the frame member 12 toward the microphone array 11. Moreover, the O-ring 13 connecting a left frame body 12*d* and the microphone array 11 is twisted slightly to the right from the frame member 12 toward the microphone array 11.

Since the O-rings 13, as the elastic bodies, adjacent to each other in the circumferential direction are thus twisted in directions opposite to each other, the microphone array 11 is supported in a balanced state with respect to the frame member 12.

It should be noted that in the present example, the total weight of the microphone array 11 and the total elastic force of the four O-rings 13 determine the resonance frequency of the microphone array 11.

Therefore, setting the resonance frequency to a low value reduces the frequency of noise generated by vibration. That is, the frequency bandwidth in which sound can be collected without being affected by the vibration noise is widened in the low-frequency side. For this reason, it is necessary to appropriately select the hardness of a rubber material forming the O-ring, a ring diameter, and a wire diameter in accordance with the weight of the microphone array 11.

Meanwhile, on the frame member 12, abutting portions 15 are formed on both outer sides of the locking portions 14. The abutting portion 15 functions to position a pair of windscreens 16 having hemispherical outer shells.

That is, each windscreen 16 is formed in a bowl shape, and has a space portion 16*a*. As the pair of windscreens 16 is combined to form a spherical shape, with the abutting portions 15 of the frame member 12 being positioned at the center, the microphone array 11 is housed in the space portion 16*a* without coming into contact with the windscreens 16.

In addition, although not shown in the drawings, the sound collecting device according to the present invention is put to practical use with the windscreens 16 and the frame member 12 being covered with a microphone case made of, for example, punched metal sheet.

It should be noted that the above descriptions are based on an Ambisonics microphone in which the directional axes of the microphone units are directed outward from the respective faces of the regular tetrahedron. However, it is possible to adopt the sound collecting device according to the present invention also for an Ambisonics microphone in which the respective directional axes are set with respect to the faces of the regular hexahedron or regular polyhedrons having more faces, and it is also possible to obtain a similar effect.

What is claimed is:

1. A sound collecting device comprising:

a microphone array having unit holders to each of which a microphone unit is attached, the unit holders having connecting portions formed thereon, the connecting portions being connected to each other such that a directional axis of each microphone unit is directed outward from a face of a regular polyhedron;

a frame member disposed outside the microphone array in a manner to surround the microphone array; and an even number of ring-shaped elastic bodies that connect a part of the frame member and the unit holders connected to each other, at a plurality of positions therebetween such that the microphone array is positioned at a central portion of the frame member, wherein a half of the even number of elastic bodies are connected in a manner to be twisted in one direction from the frame member toward the microphone array, and another half of the elastic bodies are connected in a manner to be twisted in an opposite direction from the frame member toward the microphone array.

2. The sound collecting device according to claim 1, wherein the ring-shaped elastic bodies are disposed in a manner to straddle the connecting portions formed on the unit holders, and disposed on the unit holder side as a result of the connecting portions being connected to each other.

3. The sound collecting device according to claim 1, wherein the respective elastic bodies adjacent to each other in a circumferential direction are twisted in directions opposite to each other.

4. The sound collecting device according to claim 1, wherein the ring-shaped elastic bodies are O-rings each made of a rubber material, and each of the O-rings connects each connecting portion connecting the unit holders to each other and each locking portion formed on an inner peripheral edge of the frame member, in a circular manner, such that the microphone array is positioned at the central portion of the frame member.

5. The sound collecting device according to claim 1, wherein the connecting portions are formed on the unit holder at equal intervals along the circumferential direction of the unit holder.

6. The sound collecting device according to claim 4, wherein the frame member is formed in a flat shape, and has an arrangement space for the microphone array having a quadrilateral shape along the inner peripheral edge, and the locking portions are provided at respective longitudinal central positions of the quadrilateral inner peripheral edge.

7. The sound collecting device according to claim 6, wherein a windscreen capable of covering the microphone array without coming into contact is provided on each side of the flat-shaped frame member.

8. The sound collecting device according to claim 1, wherein

A stopper formed in a ring shape at the lower bottom of the unit holders to lock the microphone unit.

* * * * *